US011335276B2

(12) United States Patent
Lee et al.

(10) Patent No.: US 11,335,276 B2
(45) Date of Patent: May 17, 2022

(54) DISPLAY DRIVING DEVICE AND DRIVING METHOD OF ADJUSTING BRIGHTNESS OF IMAGE BASED ON AMBIENT ILLUMINATION

(71) Applicant: SILICON WORKS CO., LTD., Daejeon (KR)

(72) Inventors: Jin Ho Lee, Daejeon (KR); Heung Lyeol Lee, Daejeon (KR); Hyun Kyu Jeon, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 124 days.

(21) Appl. No.: 16/868,753

(22) Filed: May 7, 2020

(65) Prior Publication Data

US 2020/0365094 A1 Nov. 19, 2020

(30) Foreign Application Priority Data

May 16, 2019 (KR) ..... 10-2019-0057285

(51) Int. Cl.

| | |
|---|---|
| ***G09G 5/00*** | (2006.01) |
| ***G09G 3/34*** | (2006.01) |
| ***G09G 3/36*** | (2006.01) |
| *G09G 5/10* | (2006.01) |

(52) U.S. Cl.

CPC ..... *G09G 3/3406* (2013.01); *G09G 3/3607* (2013.01); *G09G 3/3648* (2013.01); *G09G 3/3413* (2013.01); *G09G 5/10* (2013.01); *G09G 2320/062* (2013.01);

(Continued)

(58) Field of Classification Search

CPC .. G09G 3/3406; G09G 3/3413; G09G 3/3607; G09G 3/3648; G09G 5/10; G09G 2320/062; G09G 2320/0626; G09G 2320/0673; G09G 2360/144

See application file for complete search history.

(56) References Cited

U.S. PATENT DOCUMENTS

2006/0262111 A1* 11/2006 Kerofsky ..... G09G 3/3406 345/211
2006/0267923 A1* 11/2006 Kerofsky ..... G09G 3/22 345/102

(Continued)

FOREIGN PATENT DOCUMENTS

KR 10-2008-0083932 A 9/2008
KR 10-2016-0055354 A 5/2016

(Continued)

*Primary Examiner* — Adam J Snyder
(74) *Attorney, Agent, or Firm* — Harness, Dickey & Pierce, P.L.C.

(57) ABSTRACT

A display driving device, which adjusts a brightness of an image on the basis of an ambient illumination even without an increase in amount of power consumption, includes a controller determining a clipping ratio for clipping input image data by using an ambient illumination value when the ambient illumination value is input thereto, a gain calculator calculating a frame gain which is to be applied to the input image data, based on the clipping ratio, an input image clipping unit clipping the input image data by applying the frame gain in the input image data, and a gamma converter gamma-converting clipped input image data to generate output image data.

20 Claims, 7 Drawing Sheets

(52) U.S. Cl.
CPC ..... *G09G 2320/0626* (2013.01); *G09G 2320/0673* (2013.01); *G09G 2360/144* (2013.01)

(56) References Cited

U.S. PATENT DOCUMENTS

| | | | | |
|---|---|---|---|---|
| 2007/0171217 | A1* | 7/2007 | Tsai | G09G 3/3406 345/207 |
| 2007/0171218 | A1* | 7/2007 | Hong | G09G 3/3406 345/211 |
| 2007/0222730 | A1* | 9/2007 | Kao | G09G 3/2059 345/89 |
| 2007/0291048 | A1* | 12/2007 | Kerofsky | G09G 3/3406 345/589 |
| 2008/0170031 | A1* | 7/2008 | Kuo | G09G 3/3611 345/102 |
| 2011/0254878 | A1* | 10/2011 | Mori | G09G 3/2007 345/690 |
| 2018/0005586 | A1* | 1/2018 | Park | G09G 3/3291 |
| 2018/0130434 | A1* | 5/2018 | Okamoto | G09G 3/32 |

FOREIGN PATENT DOCUMENTS

| | | | |
|---|---|---|---|
| KR | 10-2016-0058362 | A | 5/2016 |
| KR | 10-2018-0047582 | A | 5/2018 |

* cited by examiner

DISPLAY DRIVING DEVICE AND DRIVING METHOD OF ADJUSTING BRIGHTNESS OF IMAGE BASED ON AMBIENT ILLUMINATION

CROSS-REFERENCE TO RELATED APPLICATIONS

This application claims the benefit of the Korean Patent Application No. 10-2019-007285 filed on May 16, 2019, which is hereby incorporated by reference as if fully set forth herein.

FIELD

The present disclosure relates to a display, and more particularly, to adjusting a brightness of an image displayed by a display.

BACKGROUND

With the advancement of multimedia technology, various kinds of display apparatuses such as smartphones and tablet devices have been developed and supplied in addition to conventional televisions (TVs). Particularly, display apparatuses including a large screen are being applied as instrument panels to mobile means such as vehicles recently.

However, in general display apparatuses described above, a visual characteristic is relatively more reduced at a bright place than a dark place. In order to solve such a problem, a method of measuring an illumination of an ambient environment with a display apparatus placed therein and adjusting a brightness of an image displayed by the display apparatus on the basis of the measured illumination to enhance visibility has been proposed.

For example, Korean Patent Publication No. 10-2008-0083932 (hereinafter referred to as reference document 1) has proposed a method of adjusting a luminance of a backlight of a display apparatus on the basis of an illumination of an ambient environment to adjust a brightness of an image.

However, the reference document 1 and most conventional technologies use a method of adjusting the amount of power of a backlight on the basis of an illumination of an ambient environment to brighten or darken a brightness of the backlight to thereby adjust a brightness of an image, and due to this, when a display apparatus is placed in a bright environment, a higher amount of power may be inevitably needed for brightening a brightness of the backlight, causing a problem where the amount of power consumption increases.

Moreover, when a display apparatus is exposed at a high-illumination environment such as being exposed at daytime sunlight, excessive power consumption occurs inevitably, causing a problem where a color reproduction rate of the display apparatus is also reduced.

Prior Art Reference

Patent Reference

Reference document 1: Korean Patent Publication No. 10-2008-0083932 (Title of the invention: a sensor circuit and a driving method of the sensor circuit)

SUMMARY

Accordingly, the present disclosure is directed to providing a display driving device that substantially obviates one or more problems due to limitations and disadvantages of the related art.

An aspect of the present disclosure is directed to providing a display driving device and a driving method thereof, which adjust a brightness of an image on the basis of an ambient illumination even without an increase in amount of power consumption.

Another aspect of the present disclosure is directed to providing a display driving device and a driving method thereof, which adjust a brightness of an image on the basis of an ambient illumination and simultaneously enhance an RGB color reproduction rate of an RGBW type display panel.

Additional advantages and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these and other advantages and in accordance with the purpose of the disclosure, as embodied and broadly described herein, there is provided a display driving device for adjusting a brightness of an image on the basis of ambient illumination, the display driving device including: a controller determining a clipping ratio for clipping input image data by using an ambient illumination value when the ambient illumination value is input thereto; a gain calculator calculating a frame gain which is to be applied to the input image data, based on the clipping ratio; an input image clipping unit clipping the input image data by applying the frame gain in the input image data; and a gamma converter gamma-converting clipped input image data to generate output image data.

In another aspect of the present disclosure, there is provided a display driving method of adjusting a brightness of an image on the basis of ambient illumination, the display driving method including: determining a clipping ratio for clipping input image data by using an ambient illumination value when the ambient illumination value is input thereto; calculating a frame gain which is to be applied to the input image data, based on the clipping ratio; clipping the input image by applying the frame gain in the input image data; and gamma-converting clipped input image data to generate output image data.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Figure 1:
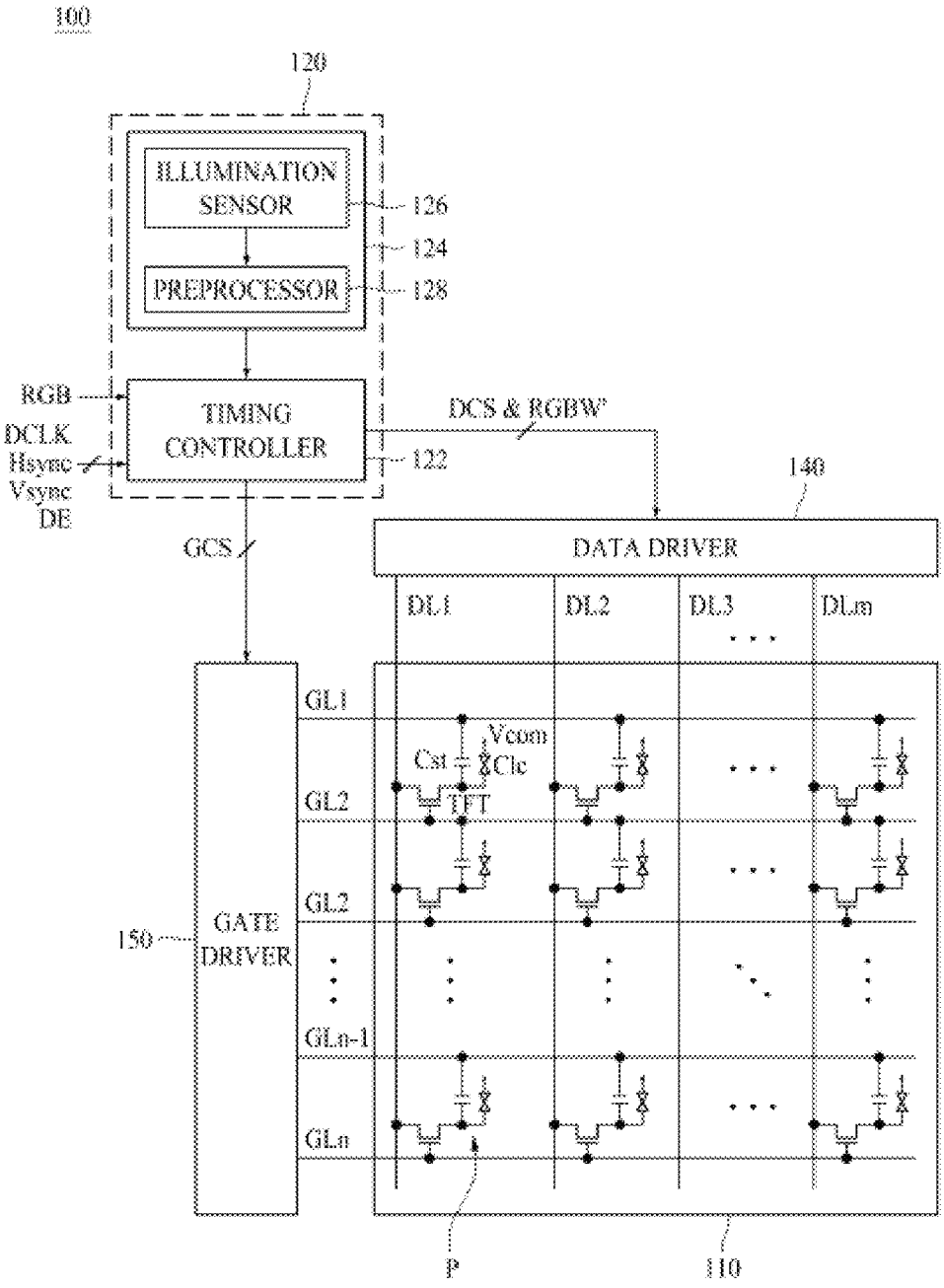
FIG. 1 is a diagram schematically illustrating a configuration of a display system to which a display driving device according to an embodiment of the present disclosure is applied.

In the specification, it should be noted that like reference numerals already used to denote like elements in other drawings are used for elements wherever possible. In the following description, when a function and a configuration known to those skilled in the art are irrelevant to the essential configuration of the present disclosure, their detailed descriptions will be omitted. The terms described in the specification should be understood as follows.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted.

In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when a position relation between two parts is described as 'on~', 'over~', 'under~', and 'next~', one or more other parts may be disposed between the two parts unless 'just' or 'direct' is used.

In describing a time relationship, for example, when the temporal order is described as 'after~', 'subsequent~', 'next~', and 'before~', a case which is not continuous may be included unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

An X axis direction, a Y axis direction, and a Z axis direction should not be construed as only a geometric relationship where a relationship therebetween is vertical, and may denote having a broader directionality within a scope where elements of the present disclosure operate functionally.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, embodiments of the present disclosure will be described in detail with reference to the accompanying drawings.

FIG. 1 is a diagram schematically illustrating a configuration of a display system 100 to which a display driving device according to an embodiment of the present disclosure is applied.

As illustrated in FIG. 1, the display system 100 to which a display driving device according to an embodiment of the present disclosure is applied may include a display panel 110, a display driving device 120, a data driver 140, and a gate driver 150.

The display panel 10 may include a plurality of gate lines GL1 to GLn and a plurality of data line DL1 to DLm, which are arranged to intersect one another and thereby define a plurality of pixel areas, and a pixel P provided in each of the plurality of pixel areas. The plurality of gate lines GL1 to GLn may be arranged in a widthwise direction and the plurality of data lines DL1 to DLm may be arranged in a lengthwise direction, but the present disclosure is not limited thereto.

In an embodiment, the display panel 110 may be a liquid crystal display (LCD) panel. When the display panel 110 is an LCD panel, the display panel 110 may include a thin film transistor TFT, provided in each of the plurality of pixel areas P defined by the plurality of gate lines GL1 to GLn and the plurality of data line DL1 to DLm, and a liquid crystal cell connected to the thin film transistor TFT.

The thin film transistor TFT may transfer a data signal, supplied through a corresponding data line DL of the data lines DL1 to DLm, to the liquid crystal cell in response to a scan pulse supplied through a corresponding gate line GL of the gate lines GL1 to GLn.

The liquid crystal cell may include a subpixel electrode connected to the thin film transistor TFT and a common electrode facing the subpixel electrode with liquid crystal therebetween, and thus, may be equivalently illustrated as a liquid crystal capacitor Clc. The liquid crystal cell may include a storage capacitor Cst connected to a previous gate line, for holding a data signal charged into the liquid crystal capacitor Clc until a next data signal is charged thereinto.

Each of the pixel areas of the display panel 110 may include red (R), green (G), blue (B), and white (W) subpixels. In an embodiment, a plurality of subpixels may be repeatedly arranged in a row direction, or may be arranged in a 2*2 matrix type. In this case, a color filter corresponding to each color may be disposed in each of the red (R), green (G), and blue (B) subpixels, and a separate color filter may not be disposed in the white (W) subpixel. In an embodiment, the red (R), green (G), blue (B), and white (W) subpixels may be provided to have the same area ratio, or the red (R), green (G), blue (B), and white (W) subpixels may be provided to have different area ratios.

In an embodiment described above, the display panel 110 has been described as an LCD panel, but the display panel 110 may be an organic light emitting diode (OLED) display panel where four subpixels are provided in each pixel area.

The display driving device 120 may include a timing controller 122 and an illumination sensing unit 124.

First, the timing controller 122 may receive various timing signals including a vertical synchronization signal Vsync, a horizontal synchronization signal Hsync, a data enable signal DE, and a clock signal CLK from an external system (not shown) to generate a data control signal DCS for controlling the data driver 140 and a gate control signal GCS for controlling the gate driver 150.

In an embodiment, the data control signal DCS may include a source start pulse (SSP), a source sampling clock (SSC), and a source output enable signal (SOE), and the gate control signal GCS may include a gate start pulse (GSP), a gate shift clock (GSC), and a gate output enable signal (GOE).

Here, the source start pulse may control a start timing of a data sampling operation performed by one or more source driver integrated circuits (ICs) (not shown) configuring the data driver 140. The source sampling clock may be a clock signal for controlling a data sampling timing in each of the one or more source driver ICs. The source output enable signal may control an output timing of the data driver 140.

The gate start pulse may control an operation start timing of each of one or more gate driver ICs (not shown) configuring the gate driver 150. The gate shift clock may be a clock signal input to the one or more gate driver ICs in common and may control a shift timing of a scan signal (a gate pulse). The gate output enable signal may designate timing information about the one or more gate driver ICs.

Moreover, the timing controller 122 according to the present disclosure may convert three-color (RGB) source image data which is received from the external system (not shown) into four-color (RGBW) input image data. The timing controller 122 may adjust a brightness of the four-color (RGBW) input image data on the basis of an ambient illumination value input from the illumination sensing unit 124. The timing controller 122 may convert brightness-adjusted four-color output image data RGBW' into data suitable for a data signal format capable of being processed by the data driver 140, and output converted data.

Figure 2:
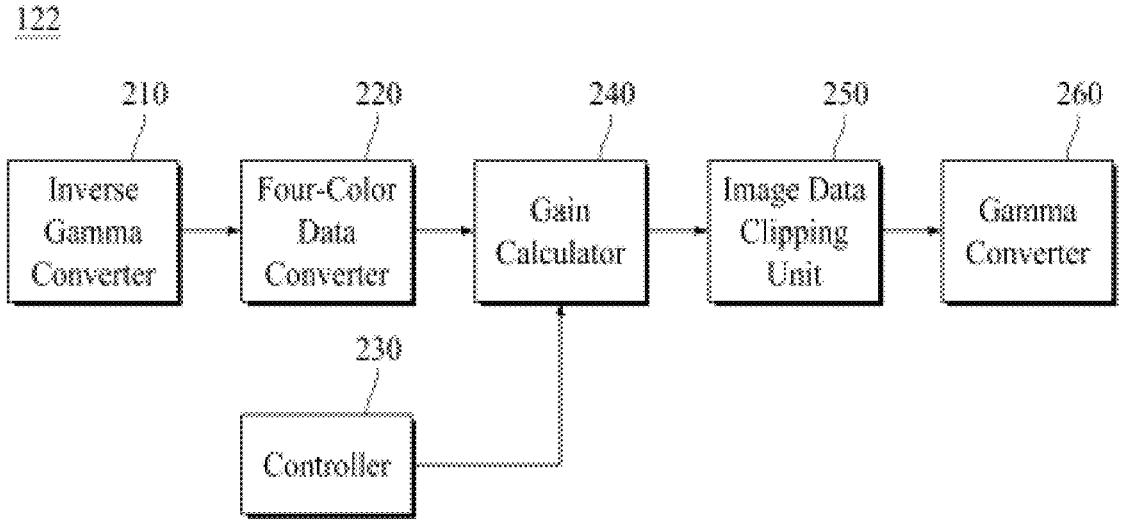
FIG. 2 is a block diagram illustrating a configuration of a timing controller illustrated in FIG. 1.

Hereinafter, a configuration of the timing controller 122 according to the present disclosure will be described in more detail with reference to FIG. 2. In FIG. 2, a function of varying a brightness of image data on the basis of an ambient illumination value among various functions performed by the timing controller 122 will be mainly described.

FIG. 2 is a block diagram illustrating a configuration of the timing controller 122 illustrated in FIG. 1. As illustrated in FIG. 2, the timing controller 122 may include an inverse gamma converter 210, a four-color data converter 220, a controller 230, a gain calculator 240, an image data clipping unit 250, and a gamma converter 260.

In FIG. 2, the timing controller 122 is described as including the inverse gamma converter 210 and the four-color data converter 220, but the inverse gamma converter 210 and the four-color data converter 220 may be optionally provided. In this case, the timing controller 122 may directly receive image data, converted into four-color data, from the outside.

The inverse gamma converter 210 may receive three-color (RGB) source image data from the external system and may convert the received three-color source image data into linearized three-color input image data. In the present disclosure, the reason that linearizes the three-color source image data by using the inverse gamma converter 210 is because the three-color source image data input from the external system is a signal on which gamma correction has been performed.

Figure 3A:
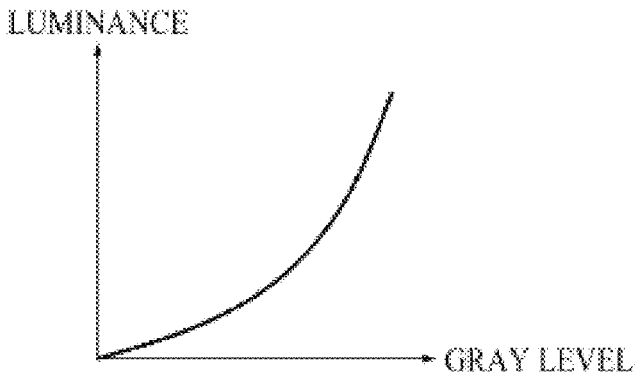
FIG. 3A is a diagram illustrating an example of an inverse function of a gamma curve.
Figure 3B:
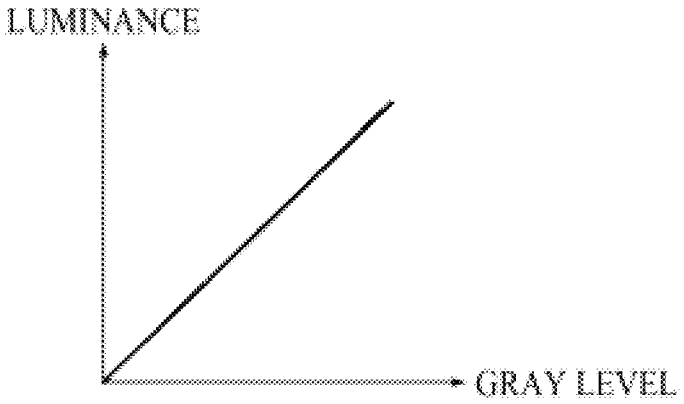
FIG. 3B is a diagram illustrating an inverse gamma conversion result of three-color source image data.
Figure 4:
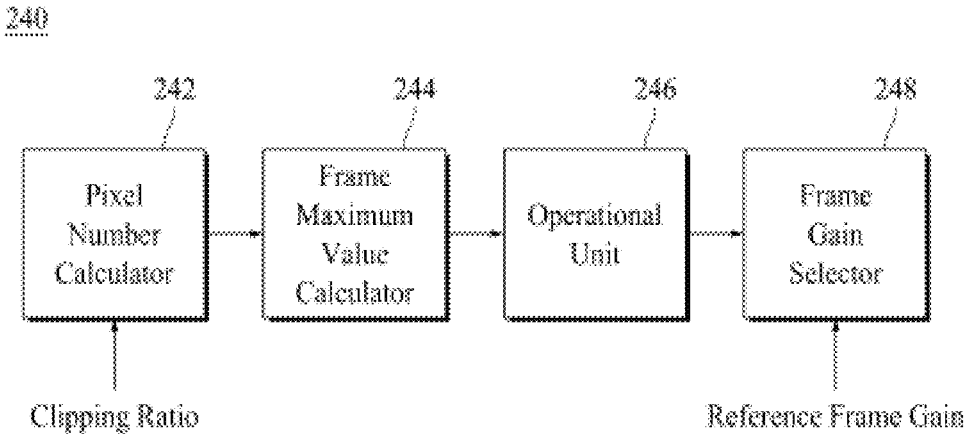
FIG. 4 is a block diagram schematically illustrating a configuration of a gain calculator illustrated in FIG. 2.

In an embodiment, by using an inverse function of a gamma curve shown in FIG. 3A, the inverse gamma converter 210 may linearize the three-color source image data into a format shown in FIG. 3B.

The four-color data converter 220 may convert the three-color input image data, output from the inverse gamma converter 210, into four-color input image data. In an embodiment, the four-color data converter 220 may first extract a common component as white data from the three-color input image data. In this case, the four-color data converter 220 may extract, as a common component, a minimum value of first red data, first green data, and first blue data constituting the three-color input image data and may generate the extracted common component as white data.

Moreover, the four-color data converter 220 may subtract the white data from each of the first red data, the first green data, and the first blue data constituting the three-color input image data to generate second red data, second green data, and second blue data. Therefore, the three-color input image data including the first red data, the first green data, and the first blue data may be converted into four-color input image data including the second red data, the second green data, the second blue data, and the white data.

In an embodiment described above, it has been described that the four-color data converter 220 extracts the common component from the three-color input image data to generate the white data and subtracts the white data from the three-color input image data to generate the four-color input image data, but this is merely an embodiment. In other embodiments, the four-color data converter 220 according to the present disclosure may convert the three-color input image data into the four-color input image data by using various methods known to those skilled in the art.

Referring again to FIG. 2, the controller 230 may receive an ambient illumination value from the illumination sensing unit 124 illustrated in FIG. 1 and may determine a clipping ratio for clipping the four-color input image data by using the received ambient illumination value.

Here, clipping may denote an operation of clipping pieces of pixel data having a most significant gray level in a histogram of input image data and multiplying the other pixel data by a frame gain to modulate pixel data, thereby allowing four-color output image data to have a color reproduction rate close to the three-color input image data. Also, a clipping ratio may represent a degree of clipping allowable for input image data.

In an embodiment, the controller 230 may determine, as a clipping ratio to be applied to corresponding four-color input image data, a clipping ratio mapped to an ambient illumination value input from the illumination sensing unit 124 in a first lookup table (not shown) where the ambient illumination value is mapped to the clipping ratio.

In this case, in the first lookup table, a clipping ratio may be set to be proportional to an ambient illumination value. That is, as an ambient illumination value increases, a clipping ratio may be mapped to have a high value, and as an ambient illumination value decreases, a clipping ratio may be mapped to have a low value.

According to such an embodiment, when there is no clipping ratio mapped to an ambient illumination value input from the illumination sensing unit 124 in the first lookup table, the controller 230 may determine a clipping ratio mapped to an ambient illumination value by using interpolation.

The controller 230 may provide the gain calculator 240 with a clipping ratio determined in the first lookup table.

The gain calculator 240 may calculate a frame gain which is to be applied to four-color input image data output from the four-color data converter 220, based on a clipping ratio determined by the controller 230.

To this end, the gain calculator 240 may include a pixel number calculator 242, a frame maximum value calculator 244, and an operational unit 246.

The pixel number calculator 242 may calculate a pixel number for clipping the four-color input image data on the basis of a clipping ratio provided from the controller 230. In an embodiment, the pixel number calculator 242 may multiply the clipping ratio, determined by the controller 230, by a predetermined reference pixel number to calculate a pixel number for clipping the three-color input image data. In this case, the reference pixel number may be mapped to a predetermined clipping ratio reference value.

The frame maximum value calculator 244 may calculate a frame maximum value (Frame Max) for clipping the four-color input image data output from the four-color data converter 220 by using the pixel number calculated by the pixel number calculator 242. In detail, the frame maximum value calculator 244 may generate a histogram by using gray level values of pixels corresponding to the four-color input image data. Subsequently, the frame maximum value calculator 244 may count a pixel number from a most significant gray level of the generated histogram, and in this case, may repeat count while reducing a gray level in the histogram until reaching a pixel number calculated by the pixel number calculator 242 and may determine, as a frame maximum value, a gray level value of when a count value reaches the pixel number calculated by the pixel number calculator 242.

A method of calculating the frame maximum value by the frame maximum value calculator 244, based on the pixel number calculated by the pixel number calculator 242, may be expressed as the following Equation 1.

$$\mathrm{MAX}'_f = \underset{k}{\operatorname{argmin}}\left(\sum_{i=k}^{255} n(i) \le P\right) \quad \text{[Equation 1]}$$

In Equation 1, $\mathrm{MAX}'_f$ may denote the frame maximum value, P may denote the pixel number calculated by the pixel number calculator 242, and n(i) may denote a pixel number where a gray level value is "i".

The operational unit 246 may calculate a frame gain which is to be applied to the four-color input image data, based on the frame maximum value calculated by the frame maximum value calculator 244 and a predetermined maximum gray level value. In an embodiment, when the maximum gray level value is 255, the operational unit 246 may divide a maximum gray level value "255" by the frame maximum value to calculate a frame gain as in the following Equation 2.

$$K'_f = \frac{255}{\mathrm{MAX}'_f} \quad \text{[Equation 2]}$$

In Equation 2, $K'_f$ may denote the frame gain, and $\mathrm{MAX}'_f$ may denote the frame maximum value calculated by the frame maximum value calculator 244.

In an embodiment described above, it has been described that the gain calculator 240 calculates only the frame gain. In this case, a pixel gain applied to each pixel included in one frame may be already reflected in the four-color input image data.

However, in another embodiment, the gain calculator 240 may directly calculate the pixel gain which is to be applied to each pixel in one frame. According to such an embodiment, the gain calculator 240 may further include a pixel gain calculator (not shown) for calculating the pixel gain.

The pixel gain calculator may calculate the pixel gain by units of one pixel of a corresponding frame by using a ratio of an achromatic signal and a chromatic signal in a unit frame of the four-color input image data.

In an embodiment, when four-color input image data corresponding to three-color input image data of a full white color is input, the pixel gain calculator may calculate the pixel gain so that the four-color input image data has the same luminance as that of the three-color input image data of the full white color. This is because the three-color input image data of the full white color is an image representing full white and the display panel 110 should have maximum brightness, but when a luminance of the display panel 110 is reduced based on an ambient illumination value, a contrast of an image is reduced, causing a reduction in image quality.

Figure 5A:
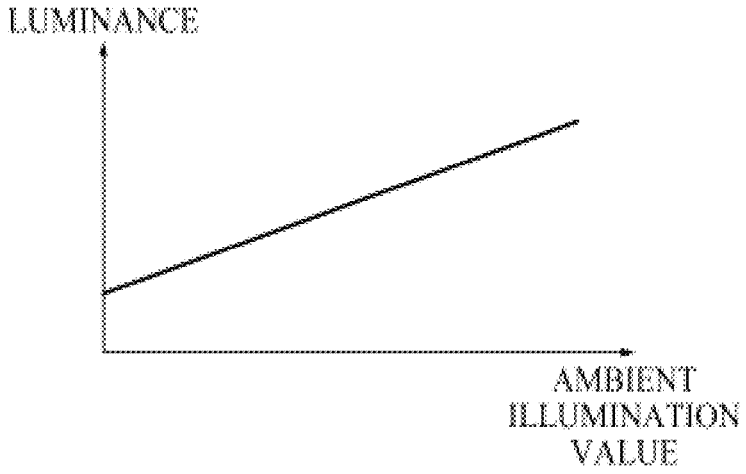
FIG. 5A is a graph showing an example where a brightness of four-color input image data is adjusted based on ambient illumination.
Figure 5B:
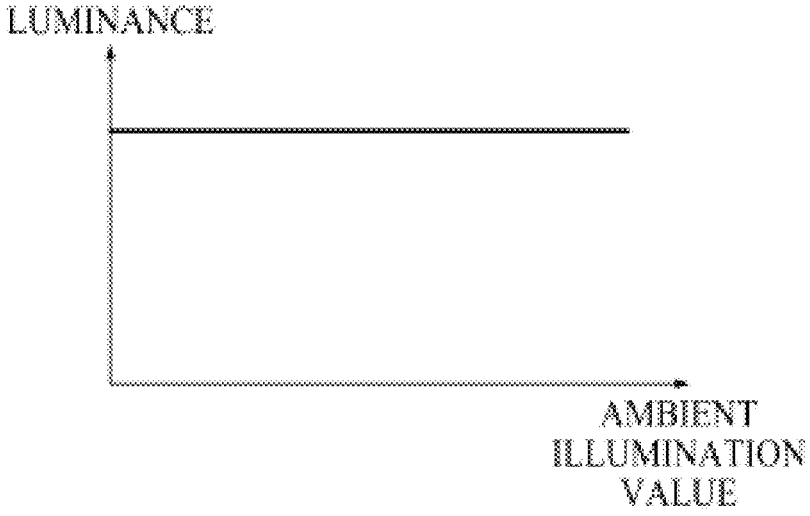
FIG. 5B is a graph showing an example where a brightness of four-color input image data corresponding to a full white color image is maintained to be constant regardless of ambient illumination.

Therefore, in the present disclosure, when four-color input image data corresponding to three-color input image data (for example, image data of a white solid pattern having gray level values "192, 192, and 192") except a full white color is input as shown in FIG. 5A, a luminance of the four-color input image data may be adjusted by adjusting a frame gain and a pixel gain on the basis of an ambient illumination value. When four-color input image data corresponding to three-color input image data (for example, a white solid pattern having gray level values "255, 255, and 255") of a full white color is input as shown in FIG. 5B, the four-color input image data may have maximum luminance by adjusting a pixel gain regardless of an ambient illumination value.

In an embodiment described above, it has been described that the gain calculator 240 calculates a frame gain on the basis of a clipping ratio determined by the controller 230 and directly applies the calculated frame gain to four-color input image data.

However, in a case where a clipping ratio mapped to an ambient illumination value is set to be too high in the first lookup table, a frame gain may be inevitably calculated to be high, and thus, a brightness of four-color input image data may be too bright, causing a phenomenon where bales of an image occur in pixels having high gray level values.

In order to solve such a problem, the controller 230 according to the present disclosure may determine a reference frame gain corresponding to an ambient illumination value input from the illumination sensing unit 124 in a second lookup table where experimentally determined reference frame gains are respectively mapped to ambient illumination values and may provide the determined reference frame gain to the gain calculator 240, and the gain calculator 240 may select one frame gain from between a frame gain calculated based on a clipping ratio and a reference frame gain transferred from the controller 230 and may set the selected frame gain as a final frame gain which is to be applied to four-color input image data.

To this end, the gain calculator 240 may further include a frame gain selector 248 for selecting one frame gain from between the frame gain calculated based on the clipping ratio and the reference frame gain.

The frame gain selector 248 may compare the reference frame gain with the frame gain calculated based on the clipping ratio, and when the calculated frame gain is less than the reference frame gain as a result of the comparison, the frame gain selector 248 may determine the calculated frame gain as a final frame gain. However, when the calculated frame gain is equal to or greater than the reference frame gain as a result of the comparison, the frame gain selector 248 may determine the reference frame gain as the final frame gain.

In an embodiment described above, it has been described that the controller 230 determines the reference frame gain and transfer the reference frame gain to the gain calculator 240. In a modified embodiment, the controller 230 may determine a reference frame maximum value for calculating the reference frame gain. In this case, the controller 230 may obtain the reference frame maximum value mapped to an ambient illumination value sensed by the illumination sensing unit 124 in a third lookup table where ambient illumination values are mapped to reference frame maximum values. The controller 230 may transfer the reference frame maximum value to the gain calculator 240 and the gain calculator 240 may divide a maximum gray level value by the reference frame maximum value transferred from the controller 230 to calculate the reference frame gain.

Referring again to FIG. 2, the image clipping unit 250 may reflect the final frame gain, calculated by the gain calculator 240, in four-color input image data output from the four-color data converter 220 to clip the four-color input image data. In this case, when there is a pixel having a grey level value greater than a maximum gray level value among pixels included in the four-color input image data by reflecting the final frame gain in the four-color input image data, the image clipping unit 250 may adjust a gray level value of a corresponding pixel to the maximum gray level value.

The gamma converter 260 may gamma-correct four-color input image data clipped by the image clipping unit 250 to generate four-color output image data RGBW'. In an embodiment, the gamma converter 260 may gamma-correct the four-color input image data, output from the image clipping unit 250, to four-color output image data RGBW' suitable for a driving circuit of the display panel 110 by using a lookup table.

As described above, according to the present disclosure, a frame gain may be determined based on a clipping ratio determined based on an ambient illumination value, and clipping may be performed by reflecting the frame gain in four-color input image data, thereby securing a brightness of four-color input image data and enabling the four-color input image data to have a color reproduction rate close to three-color input image data even without an additional increase in power.

Moreover, according to the present disclosure, in an environment (i.e., a dark environment where an ambient illumination value is low) where all of the details and saturation of an image are important, by decreasing a clipping ratio, the details of the image may be enhanced, and simultaneously, the saturation of the image may be minimized. Also, in an environment (i.e., a bright environment where an ambient illumination value is high) which is difficult to check the details of an image, by maximally increasing brightness, a contrast of the image may be enhanced.

Referring again to FIG. 1, the illumination sensing unit 124 may include an illumination sensor 126 and a preprocessor 128.

The illumination sensor 126 may sense an ambient illumination value and may provide the ambient illumination value to the preprocessor 128. In an embodiment, the illumination sensor 128 may be implemented in plurality and may be installed outside the display system 100.

The preprocessor 128 may preprocess the ambient illumination value sensed by the illumination sensor 126 and may provide a preprocessed ambient illumination value to the timing controller 122.

In an embodiment, when a first ambient illumination value sensed by the illumination sensor 126 at a current time is first threshold value more than a second ambient illumination value sensed by the illumination sensor 126 at a previous time, the preprocessor 128 may decrease the first ambient illumination value by a predetermined first reference value to preprocess the first ambient illumination value.

In another embodiment, when the first ambient illumination value is first threshold value less than the second ambient illumination value, the preprocessor 128 may increase the first ambient illumination value by the predetermined first reference value to preprocess the first ambient illumination value.

As described above, the reason that the illumination sensing unit 124 according to the present disclosure preprocesses an ambient illumination value sensed by the illumination sensor 126 and transfers a preprocessed ambient illumination value to the timing controller 122 is following. In a case where the display system 100 according to the present disclosure is applied to an instrument panel for vehicles, illumination can be suddenly reduced when a vehicle enters a tunnel and in this case, dazzling of a user occurs when a brightness of an image increases rapidly based on varied illumination. Also, illumination can increase rapidly when the vehicle gets out the tunnel, and the visibility of the image can be considerably reduced when a brightness of the image is rapidly reduced based on the varied illumination.

As described above, in a case where the display system 100 according to the present disclosure is applied to an instrument panel of a vehicle, a brightness of an image displayed by the instrument panel may be adaptively adjusted based on ambient illumination which varies when the vehicle is driving, thereby enhancing the visibility of the image even without an increase in amount of power consumption.

However, the present disclosure is not limited thereto, and in a case where the display system 100 according to the present disclosure is applied to a display panel for outdoor advertisement, a brightness of an image displayed on a billboard may be adjusted based on ambient illumination even without an increase in amount of power consumption, thereby enhancing the visibility of the image.

Referring again to FIG. 1, the data driver 140 may convert aligned four-color output image data, output from the timing controller 122, into a video data signal corresponding to an analog signal on the basis of the data control signal DCS supplied from the timing controller 122 and may supply the video data signal of one horizontal line to the data lines DL1 to DLm at every one horizontal period where the scan pulse is supplied to one of the gate lines GL1 to GLn.

In detail, the data driver 140 may select a gamma voltage having a certain level on the basis of a gray level value of the four-color output image data and may supply the selected gamma voltage to the data lines DL1 to DLm.

The data driver 140 may be disposed at one side (for example, an upper side) of the display panel 110 as illustrated, and depending on the case, may be disposed at all of the one side and the other side (for example, the upper side and a lower side) of the display panel 110 facing each other. The data driver 140 may include a plurality of source driver ICs. The data driver 140 may be implemented as the form of a tape carrier package with a source driver IC mounted thereon, but is not limited thereto.

In an embodiment, the source driver ICs may each include a shift register, a latch, a digital-to-analog converter (DAC), and an output buffer. Also, each of the source driver ICs may further include a level shifter which shifts a voltage level of digital data, corresponding to the four-color output image data output from the timing controller 122, to a desired voltage level.

The gate driver 150 may include a shift register which sequentially generates the scan pulse (i.e., a gate high pulse) in response to the gate start pulse (GSP) and the gate shift clock (GSC) among the gate control signal GCS from the timing controller 122. In response to the scan pulse, the thin film transistor TFT may be turned on.

The gate driver 150 may be disposed at one side (for example, a left side) of the display panel 110 as illustrated, and depending on the case, may be disposed at all of one side and the other side (for example, a left side and a right side) of the display panel 110 facing each other. The gate driver 150 may include a plurality of gate driver ICs. The gate driver 150 may be implemented in the form of a tape carrier package with a gate driver IC mounted thereon, but is not limited thereto. In other embodiments, the gate driver ICs may be directly mounted on the display panel 110.

Hereinafter, a display driving method of adjusting a brightness of an image on the basis of ambient illumination according to the present disclosure will be described with reference to FIGS. 6 and 7.

Figure 6:
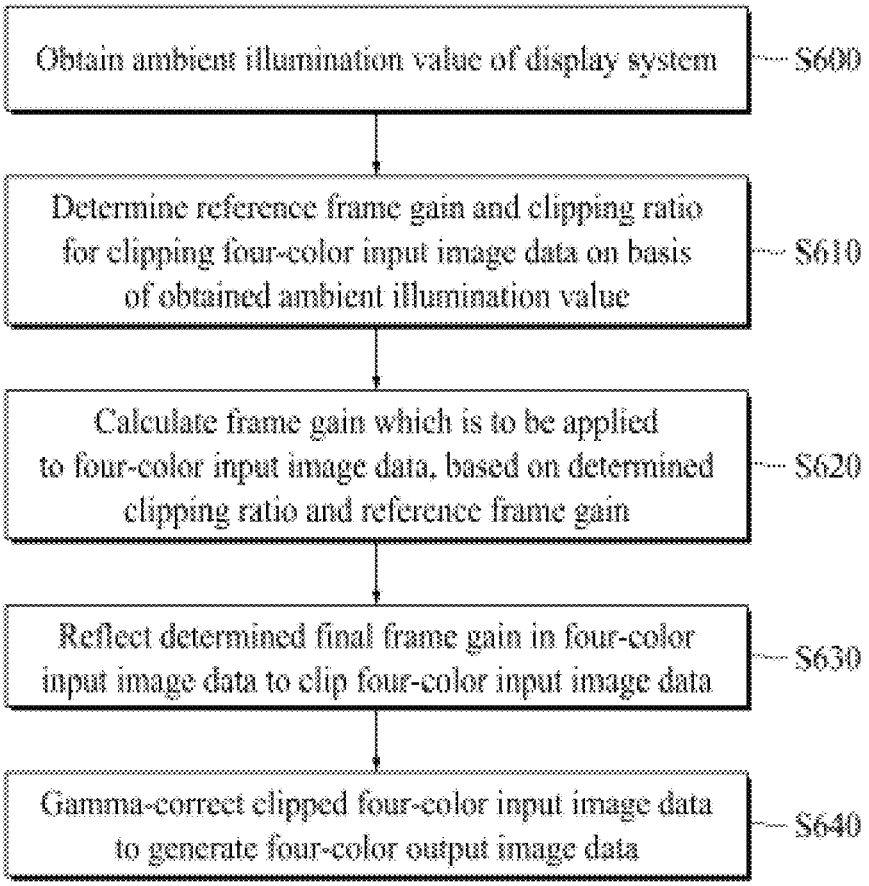
FIG. 6 is a flowchart illustrating a display driving method according to an embodiment of the present disclosure.

FIG. 6 is a flowchart illustrating a display driving method according to an embodiment of the present disclosure. The display driving method illustrated in FIG. 6 may be performed by the timing controller illustrated in FIG. 1.

First, the timing controller 122 may obtain an ambient illumination value of the display system 100 in operation S600. In an embodiment, the timing controller 122 may obtain the ambient illumination value from the illumination sensing unit 124 illustrated in FIG. 1.

In this case, the ambient illumination value may be an illumination value which is generated by the preprocessor 128 preprocessing an illumination value sensed by the illumination sensor 126. In detail, when a first ambient illumination value sensed at a current time is first threshold value more than a second ambient illumination value sensed at a previous time, the illumination sensing unit 124 may decrease the first ambient illumination value by a predetermined first reference value to preprocess the first ambient illumination value. Also, when the first ambient illumination value is first threshold value less than the second ambient illumination value, the illumination sensing unit 124 may increase the first ambient illumination value by the predetermined first reference value to preprocess the first ambient illumination value.

As described above, the reason that the illumination sensing unit 124 according to the present disclosure preprocesses an ambient illumination value and transfers a preprocessed ambient illumination value to the timing controller 122 is following. In a case where the display system 100 according to the present disclosure is applied to an instrument panel for vehicles, illumination can be suddenly reduced when a vehicle enters a tunnel, and in this case, dazzling of a user occurs when a brightness of an image increases rapidly based on varied illumination. Also, illumination can increase rapidly when the vehicle gets out the tunnel, and the visibility of the image is considerably reduced when a brightness of the image is rapidly reduced based on the varied illumination.

Subsequently, in operation S610, the timing controller 122 may determine a reference frame gain and a clipping ratio for clipping four-color input image data on the basis of the obtained ambient illumination value. In an embodiment, the timing controller 122 may determine, as a clipping ratio to be applied to corresponding four-color input image data, a clipping ratio mapped to an ambient illumination value in the first lookup table where ambient illumination values are mapped to clipping ratios.

Moreover, the timing controller 122 may determine, as the reference frame gain, a frame gain value mapped to the ambient illumination value in the second lookup table where ambient illumination values is mapped to reference frame gains.

In this case, in the first lookup table, a clipping ratio may be set to be proportional to an ambient illumination value. That is, as an ambient illumination value increases, a clipping ratio may be mapped to have a high value, and as an ambient illumination value decreases, a clipping ratio may be mapped to have a low value.

According to such an embodiment, when a clipping ratio mapped to the ambient illumination value obtained in operation S600 is not included in the first lookup table or a reference frame gain mapped to the ambient illumination value obtained in operation S600 is not included in the second lookup table, the timing controller 122 may determine the reference frame gain and the clipping ratio each mapped to the ambient illumination value by using interpolation.

Subsequently, in operation S620, the timing controller 122 may calculate a frame gain which is to be applied to the four-color input image data, based on the clipping ratio and the reference frame gain each determined in operation S610. Hereinafter, a method of calculating a frame gain by using a timing controller according to the present disclosure will be described in more detail with reference to FIG. 7.

Figure 7:
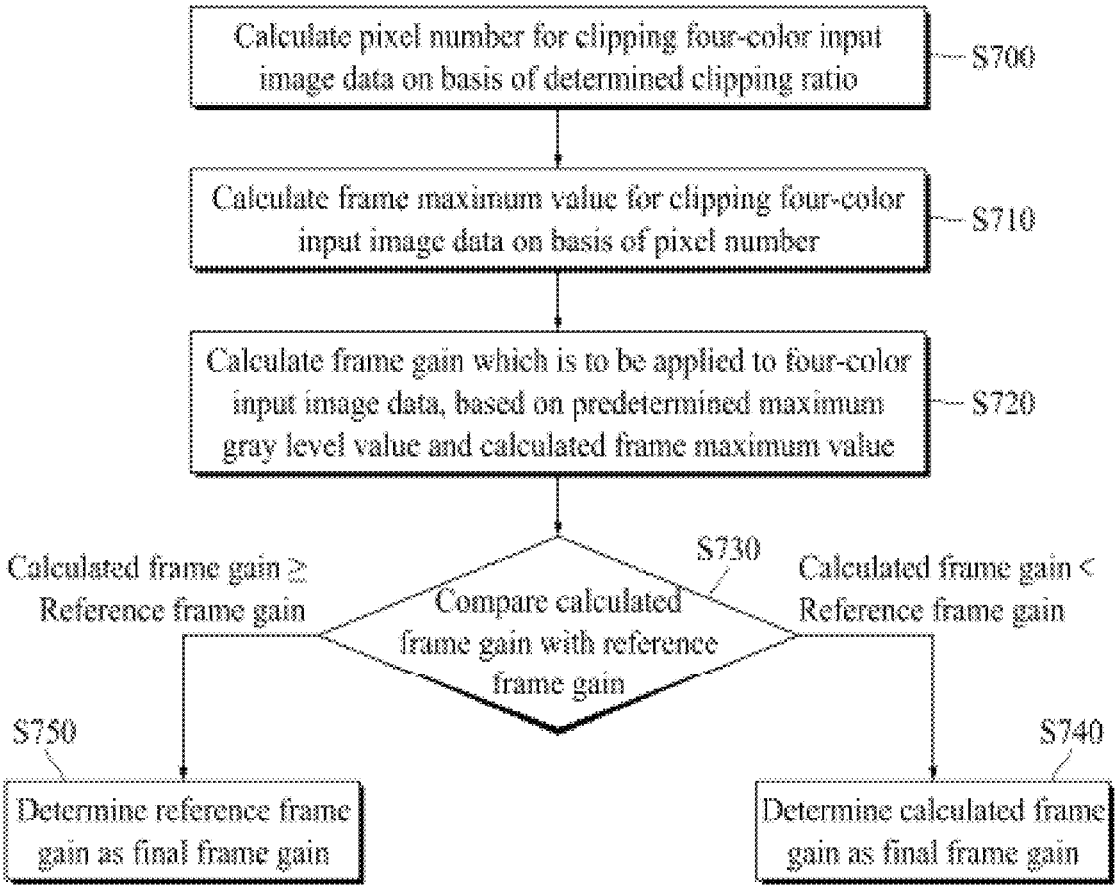
FIG. 7 is a flowchart illustrating a method of calculating a frame gain by using a timing controller, according to an embodiment of the present disclosure.

FIG. 7 is a flowchart illustrating a method of calculating a frame gain by using a timing controller, according to an embodiment of the present disclosure.

As illustrated in FIG. 7, in operation S700, the timing controller 122 may calculate a pixel number for clipping four-color input image data on the basis of the clipping ratio which is determined in operation S610. In an embodiment, the timing controller 122 may multiply the clipping ratio, determined in operation S610, by a reference pixel number mapped to a predetermined clipping ratio reference value.

Subsequently, in operation S710, the timing controller 122 may calculate a frame maximum value (Frame Max) for clipping the four-color input image data on the basis of the pixel number which is calculated in operation S700. In detail, the timing controller 122 may generate a histogram by using gray level values of pixels corresponding to the four-color input image data. Also, the timing controller 122 may count a pixel number from a most significant gray level of the generated histogram, and in this case, may repeat count while reducing a gray level in the histogram until reaching a pixel number which is calculated in operation S700 and may determine, as a frame maximum value, a gray level value of when a count value reaches the pixel number which is calculated in operation S700.

A method of calculating a frame maximum value on the basis of a pixel number by using the timing controller 122 may be expressed as Equation 1 described above.

Subsequently, in operation S720, the timing controller 122 may calculate a frame gain which is to be applied to the four-color input image data, based on a predetermined maximum gray level value and the frame maximum value which is calculated in operation S710. In an embodiment, when the maximum gray level value is 255, the timing controller 122 may divide the maximum gray level value "255" by a frame maximum value to calculate the frame gain as in Equation 2 described above.

Subsequently, in operation S730, the timing controller 122 may compare the reference frame gain, determined in operation S600, with the frame gain which is calculated in operation S720. When the calculated frame gain is less than the reference frame gain as a result of the comparison which is performed in operation S730, the timing controller 122 may determine, as a final frame gain, the frame gain which is calculated in operation S720. However, when the frame gain calculated in operation S720 is equal to or greater than the reference frame gain as a result of the comparison which is performed in operation S730, the timing controller 122 may determine the reference frame gain as the final frame gain in operation S750.

As described above, the reason that the timing controller 122 according to the present disclosure determines the final frame gain on the basis of a result of comparison of the frame gain calculated in operation S720 and the reference frame gain is because, in a case where a clipping ratio mapped to an ambient illumination value is set to be too high in the first lookup table, a frame gain is inevitably calculated to be high, and thus, a brightness of four-color input image data is too bright, causing a phenomenon where bales of an image occur in pixels having high gray level values.

In an embodiment described above, it has been described that the timing controller 122 compares the frame gain, calculated in operation S720, with the reference frame gain to calculate the final frame gain. In a modified embodiment, however, the timing controller 122 may determine the frame gain, calculated in operation S720, as the final frame gain. In this case, operations S730 to S750 may be omitted.

Referring again to FIG. 6, the timing controller 122 may reflect the final frame gain, determined in operation S750, in four-color input image data to clip the four-color input image data in operation S630. In this case, by reflecting the final frame gain in the four-color input image data, when there is a pixel having a gray level value greater than a maximum gray level value among pixels included in the four-color input image data, the timing controller 122 may adjust a gray level value of a corresponding pixel to the maximum gray level value.

Subsequently, in operation S640, the timing controller 122 may gamma-correct four-color input image data clipped in operation S630 to generate four-color output image data. In an embodiment, the timing controller 122 may gamma-correct the four-color input image data, generated in operation S640, to four-color output image data suitable for a driving circuit of the display panel 110 by using a lookup table.

Although not shown in FIG. 6, the timing controller 122 according to the present disclosure may further perform an operation of performing inverse gamma conversion on three-color source image data input from the external system to generate linearized three-color input image data and an operation of converting three-color input image data into four-color input image data.

In an embodiment, in converting the three-color input image data into the four-color input image data, the timing controller 122 may first extract a common component as white data from the three-color input image data and may subtract the white data from each of first red data, first green data, and first blue data constituting the three-color input image data to generate second red data, second green data, and second blue data, thereby converting the three-color input image data into the four-color input image data.

In this case, the timing controller 122 may extract, as a common component, a minimum value of first red data, first green data, and first blue data constituting the three-color input image data and may generate the extracted common component as white data.

In the above-described embodiment, it has been described that the timing controller 122 extracts a common component from the three-color input image data to generate white data and subtracts white data from the three-color input image data to generate four-color input image data, but this is merely an embodiment. In other embodiments, the timing controller 122 according to the present disclosure may convert the three-color input image data into the four-color input image data by using various methods known to those skilled in the art.

It may be understood that those skilled in the art may implement the above-described embodiments into another detailed form without changing the technical spirit or essential feature of the present disclosure.

For example, a timing controller according to the present disclosure may be implemented as an IC type, and a function of the timing controller may be implemented in the form of programs and may be equipped in an IC. In a case where a function of the timing controller according to the present disclosure is implemented as a program, a function of each element included in the timing controller may be implemented as a specific code, and codes for implementing the specific function may be implemented as one program or may be divided into and implemented as a plurality of programs.

According to the embodiments of the present disclosure, a brightness of an image may be adjusted by adjusting a frame gain which is to be applied to each frame of an image, based on ambient illumination, and thus, it may not be needed to increase power for adjusting a brightness of a backlight on the basis of the ambient illumination, thereby preventing an increase in power consumption of a display apparatus.

Moreover, according to the embodiments of the present disclosure, a brightness of an image may be adjusted by adjusting only a clipping rate on the basis of ambient illumination without an increase in power consumption in an RGBW type display panel, thereby enhancing an RGB color reproduction rate.

Moreover, according to the embodiments of the present disclosure, since it is not easy to check in detail an input image in a high-illumination environment, a brightness of the input image may maximally increase based on an increase in a clipping ratio, thereby enhancing a contrast of an image.

Moreover, according to the embodiments of the present disclosure, a clipping artifact may be minimized by reducing a clipping ratio in a low-illumination environment, thereby enhancing details of an input image and minimizing a saturation of the input image.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A display driving device for adjusting a brightness of an image on the basis of ambient illumination, the display driving device comprising:

a controller determining a clipping ratio for clipping input image data by using an ambient illumination value when the ambient illumination value is input thereto;

a gain calculator calculating a frame gain which is to be applied to the input image data, based on the clipping ratio;

an input image clipping unit clipping the input image data by applying the frame gain in the input image data; and a gamma converter gamma-converting clipped input image data to generate output image data, wherein, the gain calculator calculates a pixel number for the clipping on the basis of the determined clipping ratio and calculates the frame gain based on a gray level value determined by the calculated pixel number.

2. The display driving device of claim 1, wherein the controller determines the clipping ratio to be proportional to the ambient illumination value.

3. The display driving device of claim 1, wherein the controller determines, as a clipping ratio to be applied to the input image data, a clipping ratio mapped to the input ambient illumination value in a first lookup table where ambient illumination values are mapped to clipping ratios.

4. The display driving device of claim 1, wherein the gain calculator comprises:

a pixel number calculator calculating the pixel number;

a frame maximum value calculator generating a histogram on the basis of a gray level value of each pixel of the input image data and counting a pixel number from a number of pixels having a most significant gray level value in the histogram to determine, as a frame maximum value, the gray level value of when a counting value reaches the calculated pixel number; and an operational unit dividing a predetermined maximum gray level value by the calculated frame maximum value to calculate the frame gain.

5. The display driving device of claim 4, wherein the pixel number calculator multiplies the determined clipping ratio by a reference pixel number mapped to a predetermined clipping ratio reference value to calculate the pixel number.

6. The display driving device of claim 1, wherein the controller additionally determines a reference frame gain mapped to the input ambient illumination value in a second lookup table where ambient illumination values are mapped to reference frame gains, and when the frame gain calculated based on the determined clipping ratio is equal to or greater than the reference frame gain, the gain calculator determines the reference frame gain as a final frame gain which is to be applied to the input image data, and when the calculated frame gain is less than the reference frame gain, the gain calculator determines the calculated frame gain as the final frame gain which is to be applied to the input image data.

7. The display driving device of claim 1, further comprising a four-color data converter converting first red data, first green data, and first blue data, each constituting three-color input image data, into second red data, second green data, second blue data, and white data respectively supplied to red, green, blue, and white subpixels included in a display panel to generate four-color input image data.

8. The display driving device of claim 7, wherein the four-color data converter extracts, as the white data, a common component of the first red data, the first green data, and the first blue data and subtracts the white data from each of the first red data, the first green data, and the first blue data to generate the second red data, the second green data, and the second blue data.

9. The display driving device of claim 7, wherein when the three-color input image data is a full white color, the gain calculator additionally calculates a pixel gain so that a gray level value of each of the second red data, the second green data, the second blue data, and the white data is a maximum gray level value.

10. The display driving device of claim 1, further comprising:

an illumination sensor sensing the ambient illumination value; and a preprocessor preprocessing the ambient illumination value sensed by the illumination sensor to provide a preprocessed ambient illumination value to the controller.

11. The display driving device of claim 10, wherein the display driving device is a driving device of an instrument panel of a vehicle, and the preprocessor preprocesses an ambient illumination value sensed when the vehicle enters a tunnel or an ambient illumination value sensed when the vehicle gets out the tunnel.

12. The display driving device of claim 10, wherein when a first ambient illumination value sensed by the illumination sensor at a current time is first threshold value more than a second ambient illumination value sensed by the illumination sensor at a previous time, the preprocessor decreases the first ambient illumination value by a predetermined first reference value to preprocess the first ambient illumination value, and when the first ambient illumination value is first threshold value less than the second ambient illumination value, the preprocessor increases the first ambient illumination value by the predetermined first reference value to preprocess the first ambient illumination value.

13. A display driving method of adjusting a brightness of an image on the basis of ambient illumination, the display driving method comprising:

determining a clipping ratio for clipping input image data by using an ambient illumination value when the ambient illumination value is input thereto;

calculating a frame gain which is to be applied to the input image data, based on the clipping ratio;

clipping the input image by applying the frame gain in the input image data; and gamma-converting clipped input image data to generate output image data, wherein, in the calculating of the frame gain, a pixel number for the clipping is calculated on the basis of the determined clipping ratio and the frame gain is calculated based on a gray level value determined by the pixel number.

14. The display driving method of claim 13, wherein the calculating of the frame gain comprises:

calculating the pixel number;

generating a histogram on the basis of a gray level value of each pixel of the input image data and counting a pixel number from a number of pixels having a most significant gray level value in the histogram to determine, as a frame maximum value, the gray level value of when a counting value reaches the calculated pixel number; and dividing a predetermined maximum gray level value by the calculated frame maximum value to calculate the frame gain.

15. The display driving method of claim 14, wherein the calculating of the pixel number includes multiplying the determined clipping ratio by a reference pixel number mapped to a predetermined clipping ratio reference value to calculate the pixel number.

16. The display driving method of claim 13, wherein the determining of the clipping ratio comprises determining, as a clipping ratio to be applied to the input image data, a clipping ratio mapped to the input ambient illumination value in a first lookup table where clipping ratios are proportionally mapped to ambient illumination values.

17. The display driving method of claim 13, further comprising:

determining a reference frame gain mapped to the input ambient illumination value in a second lookup table where ambient illumination values are mapped to reference frame gains;

comparing the calculated frame gain with the reference frame gain; and determining a final frame gain based on the reference frame gain and the frame gain calculated based on the determined clipping ratio, wherein the reference frame gain is determined as a final frame gain when the calculated frame gain is equal to or greater than the reference frame gain and the calculated frame gain is determined as the final frame gain when the calculated frame gain is less than the reference frame gain, and wherein the determined final frame gain is applied to the input image data to clip the input image data when clipping the input image.

18. The display driving method of claim 13, further comprising converting three-color input image data into four-color input image data, wherein the converting comprises:

linearizing three-color source image data by using an inverse function of a gamma curve to generate the three-color input image data;

extracting a common component of first red data, first green data, and first blue data each constituting the three-color input image data to extract white data constituting four-color input image data; and subtracting the white data from each of the first red data, the first green data, and the first blue data to generate second red data, second green data, and second blue data each constituting the four-color input image data.

19. The display driving method of claim 13, further comprising:

sensing the ambient illumination value; and preprocessing the sensed ambient illumination value.

20. The display driving method of claim 19, wherein the preprocessing comprises:

when a first ambient illumination value sensed at a current time is first threshold value more than a second ambient illumination value sensed at a previous time, decreasing the first ambient illumination value by a predetermined first reference value to preprocess the first ambient illumination value; and when the first ambient illumination value is first threshold value less than the second ambient illumination value, increasing the first ambient illumination value by the predetermined first reference value to preprocess the first ambient illumination value.

* * * * *